US005522532A

United States Patent [19]

Chen

[11] Patent Number: 5,522,532

[45] Date of Patent: Jun. 4, 1996

[54] SINGLE-SHOOTING/CONTINUOUS-SHOOTING CONTROL SWITCH FOR PENUMATIC NAIL GUNS

[75] Inventor: Jacob Chen, Taichung, Taiwan

[73] Assignee: Testo Industry Corp., Taichung, Taiwan

[21] Appl. No.: 403,616

[22] Filed: Mar. 14, 1995

[51] Int. Cl.[6] ..... B25C 1/04

[52] U.S. Cl. ..... 227/8; 227/130

[58] Field of Search ..... 227/8, 120, 130

[56] References Cited

U.S. PATENT DOCUMENTS

| | | | |
|---|---|---|---|
| 3,198,412 | 8/1965 | Roosa | 227/8 |
| 3,563,438 | 2/1971 | Doyle et al. | 227/8 |
| 4,915,013 | 4/1990 | Moraht et al. | 227/130 |
| 5,174,485 | 12/1992 | Meyer | 227/8 |

*Primary Examiner*—Scott A. Smith

[57] ABSTRACT

A single-shooting/continuous-shooting control switch installed in a pneumatic nail gun for controlling the firing of nails, the control switch including a first valve seat connected to a pneumatic pressure source, a second valve seat connected between the first valve seat and the firing pin of the pneumatic nail gun, a first valve rod moved by the trigger of the pneumatic nail gun to control the air passage between the first air valve seat and the second air valve seat, a second valve rod moved by the trigger of the pneumatic nail gun to control the air passage between the second air valve seat and the firing pin, and a stop block turned about the first valve rod between between a first position for letting the first valve rod be lifted by the trigger to stop the passage between the first air passage and the second air passage for a single-shooting operation, and a second position to stop the trigger from lifting the first valve rod for letting pneumatic pressure be continuosuly drawn from the first air valve seat into the second air valve seat for a continuous shooting operation.

3 Claims, 10 Drawing Sheets

SINGLE-SHOOTING/CONTINUOUS-SHOOTING CONTROL SWITCH FOR PENUMATIC NAIL GUNS

BACKGROUND OF THE INVENTION

The present invention to nail gun control swtiches, and relates more particularly to a single-shooting/continuous-shooting control switch for nail guns.

Conventional pneumatic nail guns commonly use pnematic pressure to drive a firing pin in driving nails into workpieces, and a trigger to control the air passage between the firing pin and the pneumatic power source. In order to prevent the happening of an error triggering, a safety is installed in the nail firing head. The trigger is allowed to drive the valve rod in firing the firing pin only when the safety is released. As illustrated in FIG. 1A, the trigger of a regular pneumatic nail gun, referenced by 1, has an actuating strip 2 stopped at the bottom of the valve rod, referenced by 31, in a valve seat, referenced by 3. If the trigger 1 is depressed under this condition, the actuating 22 does no work, and therefore the valve seat 3 is still closed. When the safety, referenced by 4, at the firing head of the pneumatic nail gun is stopped against the workpiece as shown in FIG. 1B, the actuating strip 2 of the trigger i is pushed upwards to lift the valve rod 31, and therefore the air passage through the valve seat 3 to the firing pin (not shown) is opened for letting pneumatic pressure to pass and to further drive the firing pin in firing a nail. When the firing head of the pnematic nail gun is left from the workpiece fter the firing of a nail, as shown in FIG. 1C, the safety 4 is lowered to its former position, causing the actuating strip 2 moved downwards from the valve rod 31, and therefore the valve rod 31 close the air passage to the firing pin again.

Regular penumatic nail guns are commonly gathered into two types, one for single shooting and one for continuous shooting. When a pneumatic nail gun is designed for single shooting, only one nail is driven out of the nail gun each time the trigger is depressed, and the safety 4 must be removed from the workpiece after each shot so that the firing mechanism can be reset for a nest firing operation. When a penumatic nail gun is designed for continuous shooting, it will fire a rapid and continuous stream of nails when the trigger is depressed and maintained in the depressed position and the safety 4 is stopped against the workpiece. However, a pnematic nail gun for continuous shooting may be driven by an error to drive nails out of the nail gun, causing nails wasted or even somebody wounded.

SUMMARY OF THE INVENTION

The present invention has been accomplished under the circumstances, It is therefore the major object of the present invention to provide a single-shooting/continuous-shooting control switch- for pneumatic nail guns which can be conveniently controlled to set the mode of the nail gun for a single shooting or a continuous shooting alternatively.

According to one aspect of the present invention, the single-shooting/continuous-shooting control switch comprises two air valve seats linked between the penumatic pressure source and the firing pin, and two valve rods moved by the trigger of the pneymatic gun to lift the valve rods in controlling the passage between the penumatic pressure source and the firing pin, and a stop block turned about one valve rod to let the trigger lift one valve rod or both valve rods for a continuous shooting operation or a single shooting operation alternatively.

According to another aspect of the present invention, the stop block comprises a downward bottom flange defining a curved bottom hole. The curved bottom hole is disposed in engagement with one end of the trigger to let both valve rods be lifted by the trigger for a single shooting operation when the stop block is turned to a first position. The downward bottom flange is stopped against the trigger to prohibit the trigger from litfing both valve rods when the stop block is turned to a second position, and therefore a continuous shooting operation is allowed.

According to still another aspect of the present invention, the trigger comprises a pivot transversely disposed at a free end thereof, a rotary wheel turned about the pivot, and an actuating strip having two parallel eyed lugs connected to two opposite ends of the rotary wheel and turned with the rotary wheel about the pivot to lift one or both valve rods.

DETAILED DESCRIPTION OF THE PREFERRED EMBODIMENT

Figure 1A:
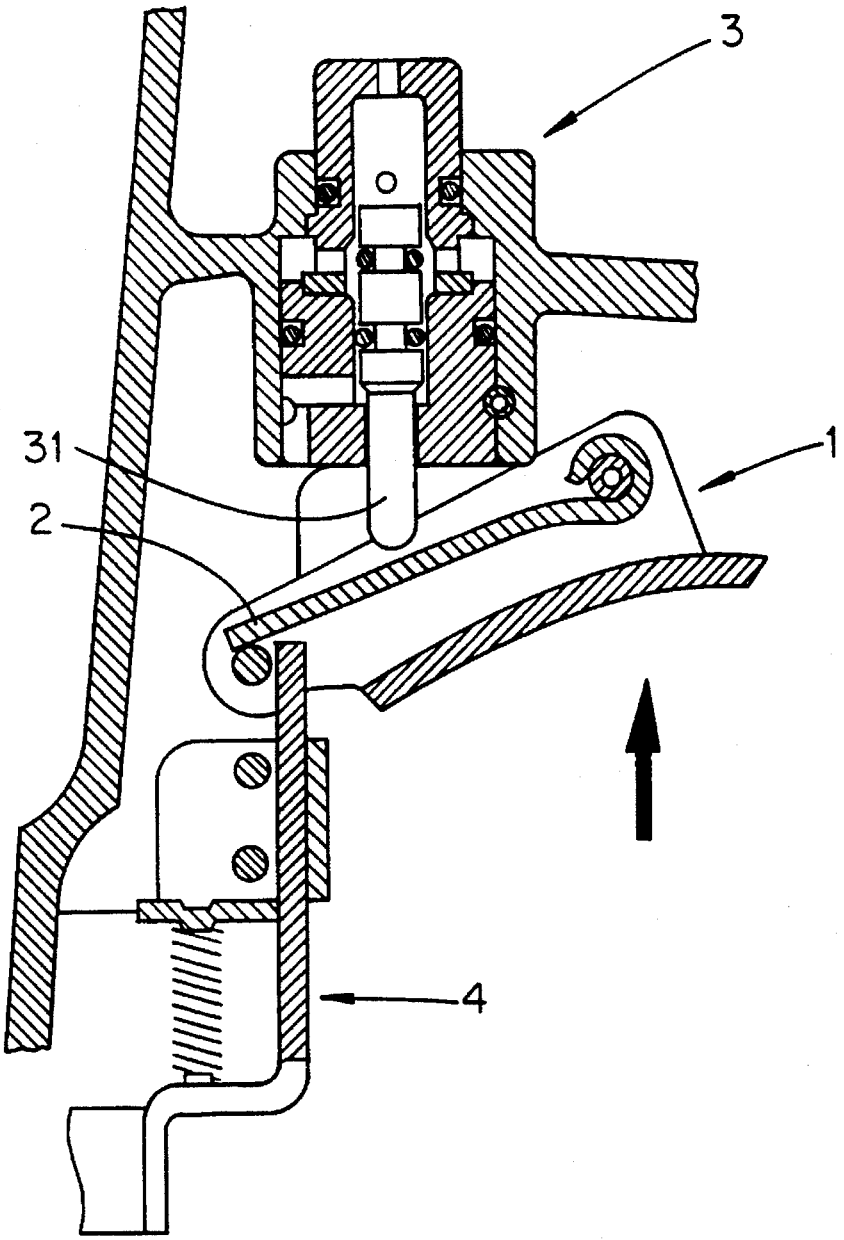
FIG. 1A PRIOR ART
FIG. 1A is a partial view-in plain of a conventional pneumatic nail gun, showing the relative positions of the trigger, the valve seat with the valve rod, and the safety.
Figure 1B:
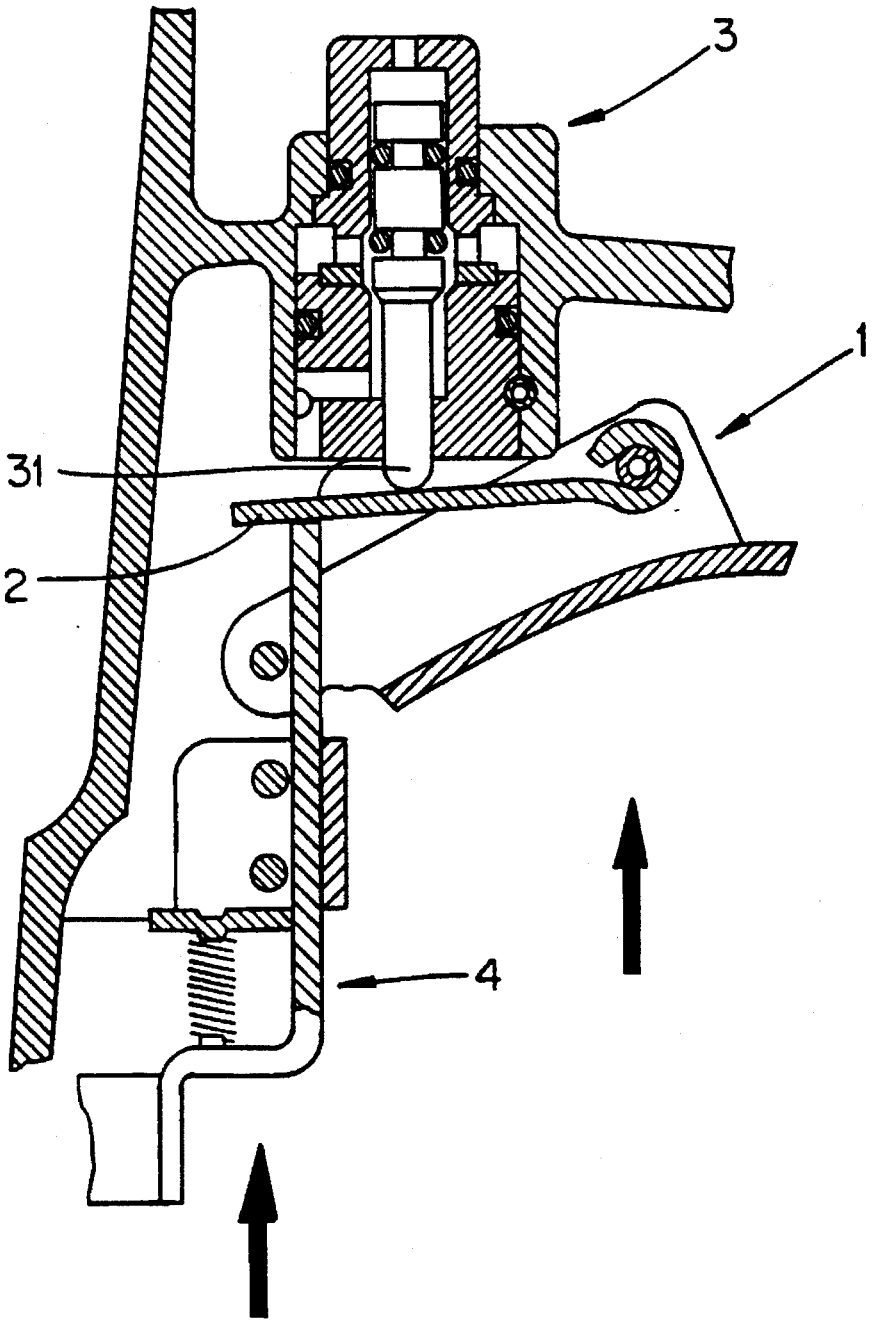
FIG. 1B PRIOR ART
FIG. 1B is similar to FIG. 1A but showing the safey moved upwards and the valve rod lifted by the safety.
Figure 1C:
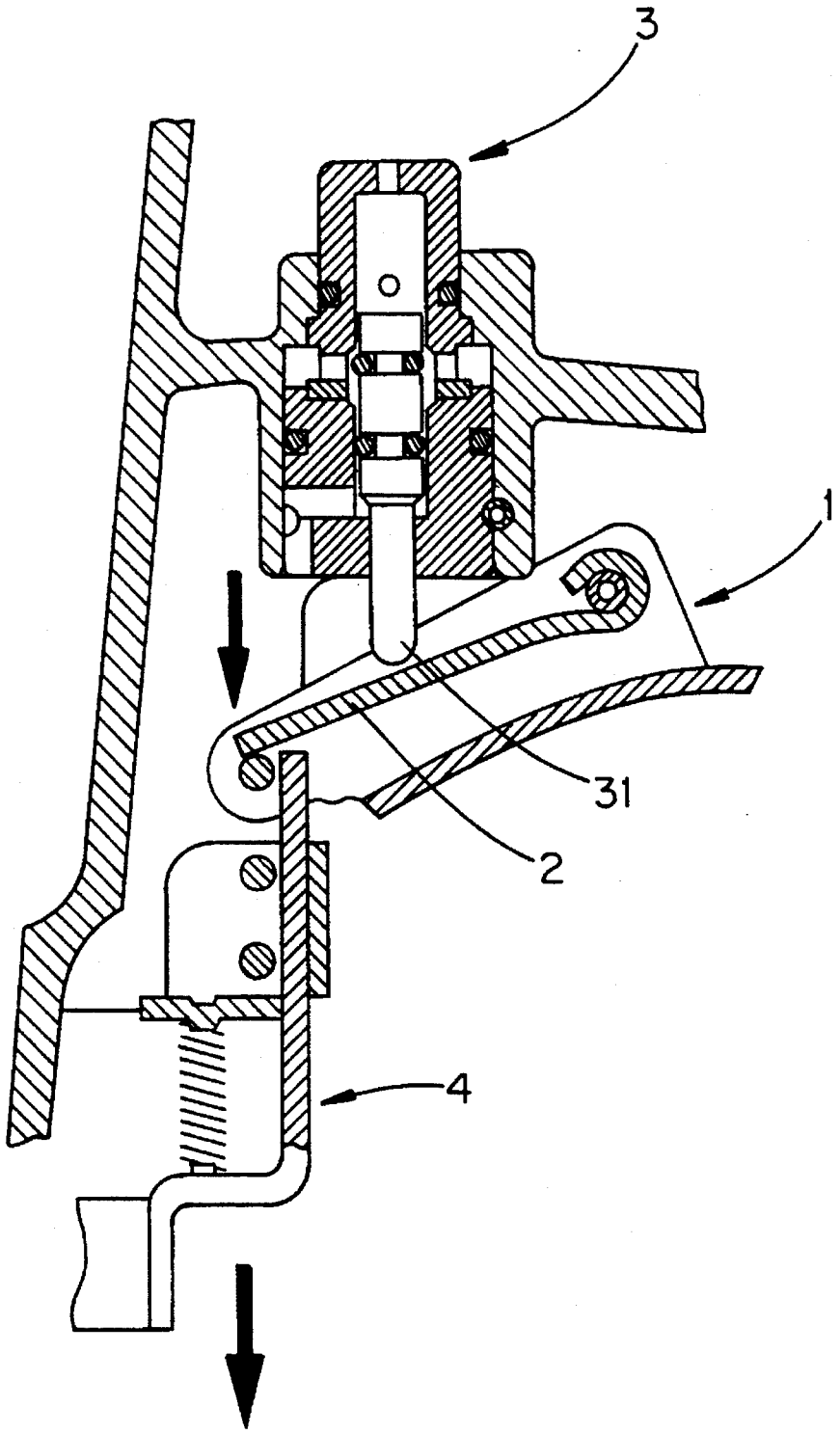
FIG. 1C PRIOR ART
FIG. 1C is similar to FIG. 1B but showing the safety and the valve rod moved back to their former positions after the triggering.
Figure 2:
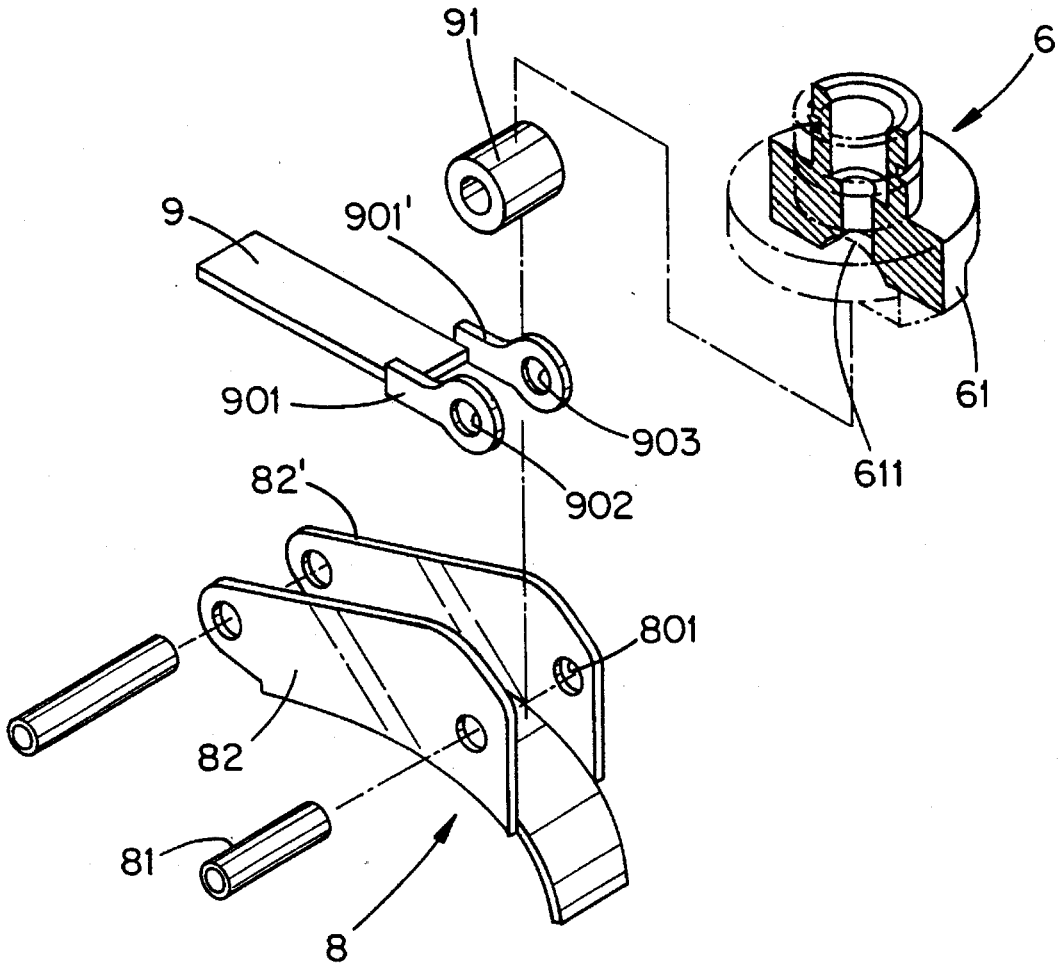
FIG. 2 is an exploded view of a part of a single-shooting/continuous-shooting control switch for pneumatic nail guns according to the present invention.
Figure 3A:
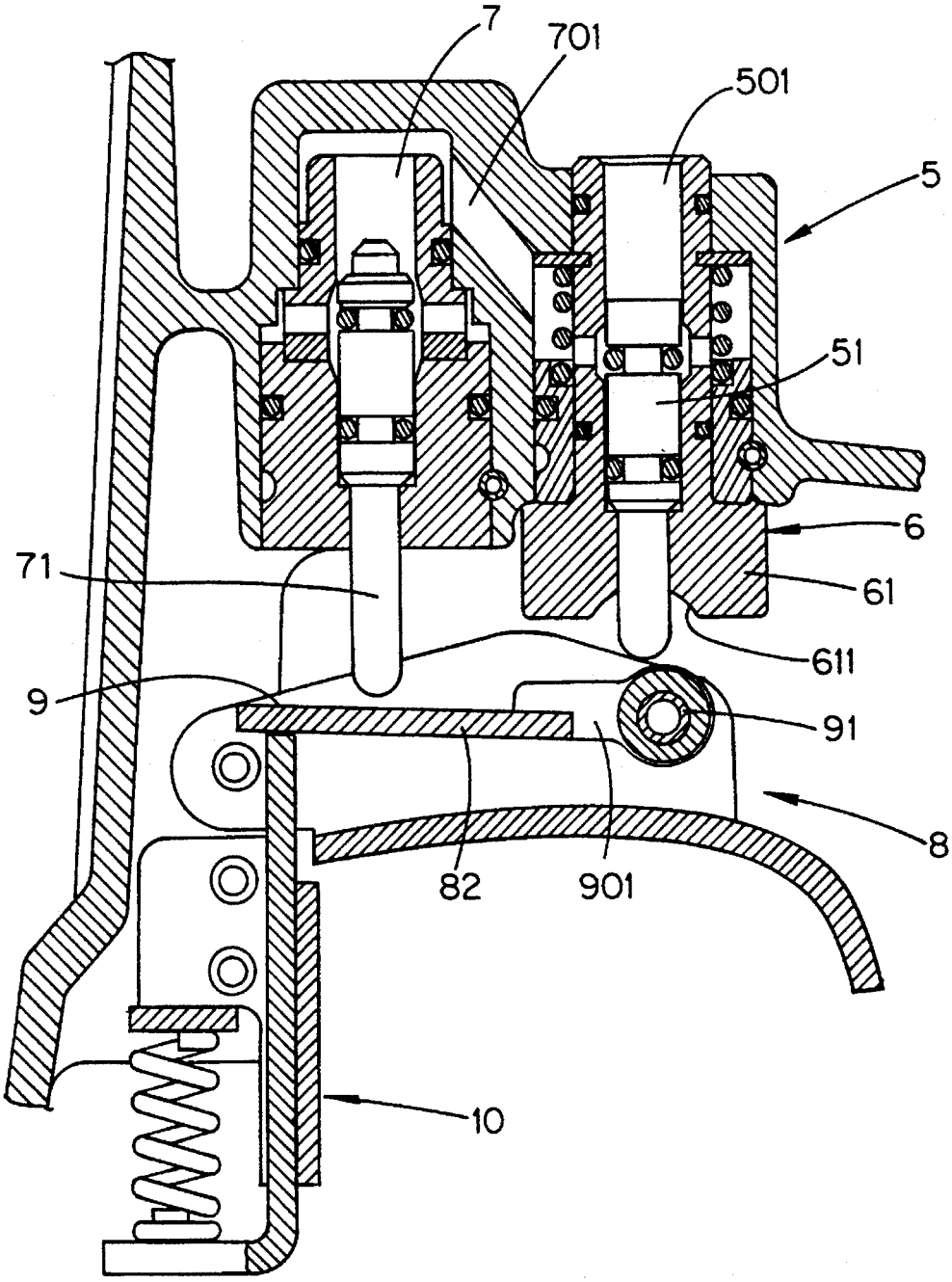
FIGS. 3A–3C are drawings of continuous action shwoing the single-shooting/continuous-shooting control switch of the preferred embodiment of the present invention installed .in the pneumatic nail gun and operated under the mode of single-shooting.

Referring to FIGS. 2 and 3A, a single-shooting/continuous-shooting control switch for penumatic nail guns in accordance with the present invention is generally comprised of a first air valve seat 5, a first valve rod 51 moved in the first air valve seat 5, an annular stop block 6 fastened to the first air valve seat 5 around the first valve rod 51, a second air valve seat 7 communicated with the air passage 501 on the first air valve seat 5 by an air passage 701, a second valve rod 71 moved in the second air valve seat 7, a trigger 8 pivoted to the shell of the peumatic nail gun and disposed below the first air valve seat 5 and the second air valve seat 7 and controlled to move the first valve rod 51 and the second valve rod 52, an actuating strip 9 pivoted to the trigger 8, a rotary wheel 91 fastenedf to the actuating strip 9 and the trigger 8, and a safety 10 for a safety control. The annular stop block 6 has a downward bottom flange 61 disposed outside the bottom side of the first air valve seat 5, defining a curved bottom hole 611. The actuating strip 9 has two parallel lugs 901 and 901 bilaterally disposed at one end, each lug defining a pivot hole 902 or 903. The rotary wheel 91 is stopped between the lugs 901 and 901' and then the lugs 901 and 901' with the rotary wheel 91 are fastened between two opposite pin holes 801 on the two parallel upright walls 82 and 82' of the trigger 8 at the rear end by a pivot 81. When installed, the rotary wheel 91 can be rotated to turn the actuating trip 9 about the pivot 81.

Figure 3B:
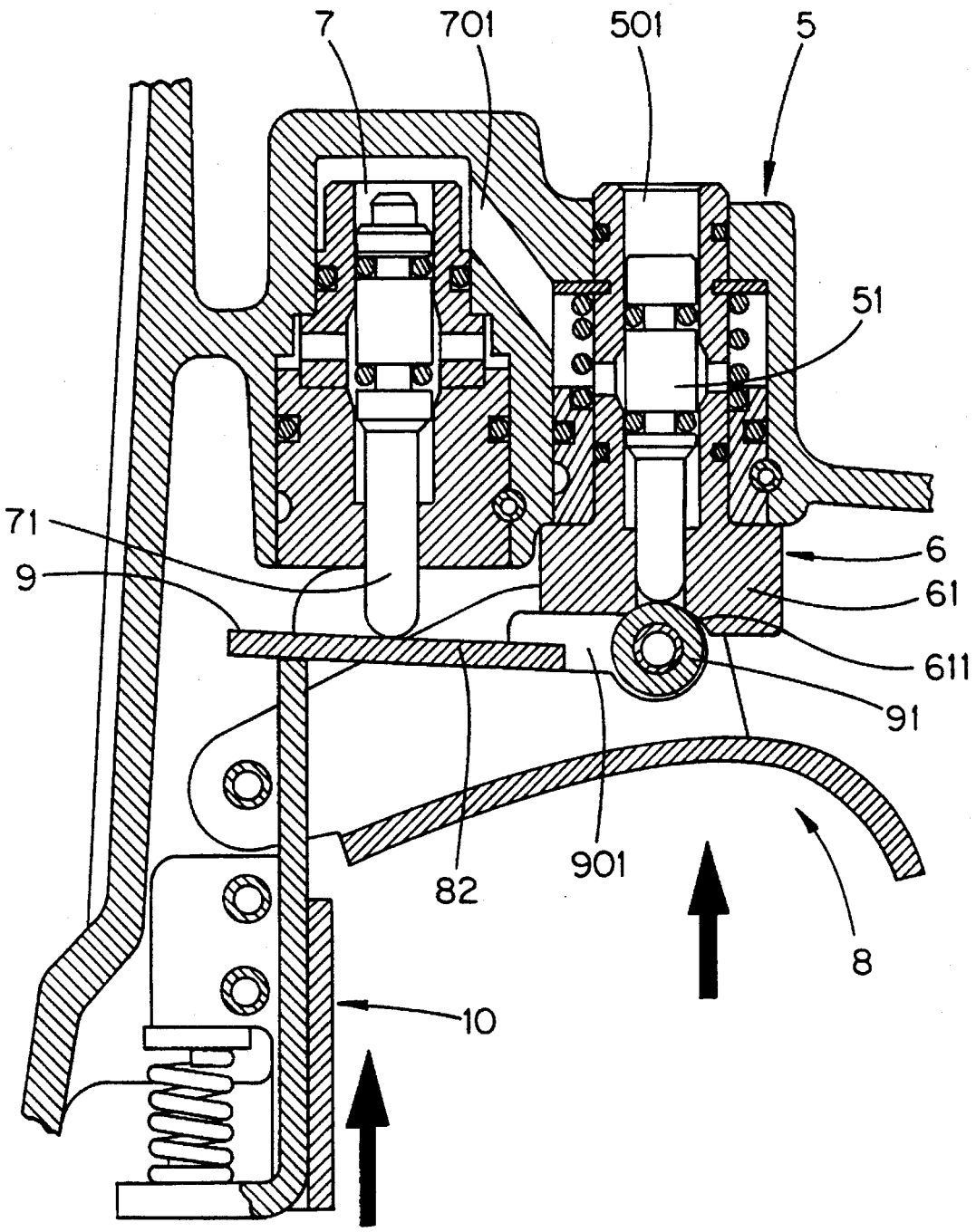
Figure 3C:
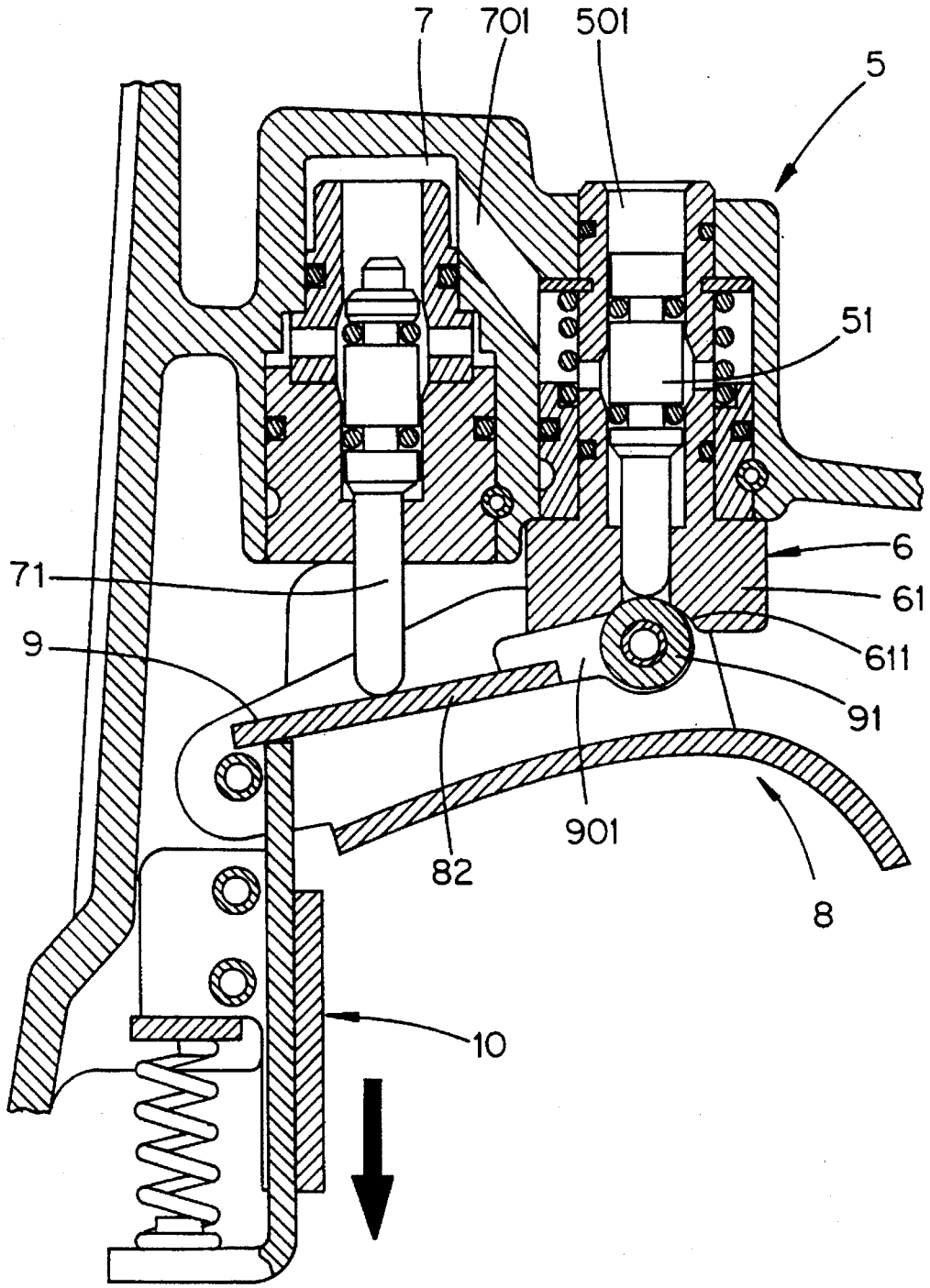

Referring to FIG. 3B, when the strop block 6 is turned about the first valve rod 51 in one direction through a predetermined angle, the downward bottom flange 61 of the stop block 6 becomes disposed in parallel to the actuating strip 9. When the trigger 8 is depressed during this stage, the rotary wheel 91 is simultaneously moved upwards and forced into engagement with the curved bottom hole 611 to further lift the first valve rod 51 in stopping the air passage 701 from the air passage 501, therefore only a fixed amount of compressed air is maintained inside the air passage 701 within the second air valve seat 7, and continuous pneumatic pressure is stopped from passing through the air passage 501 in the first air valve seat 5 into the second air valve seat 7. When the safety 10 is stopped against the workpiece to lift the second valve rod 71 after the air passage 701 of the second air valve seat 7 is closed, the actuating strip 9 is moved to lift the second valve rod 71, causing the preserved compressed air to escape out of the air passage 701 of the second air valve seat 7 and to further drive a nail out of the penumatic nail gun. When the safety 10 is removed from the workpiece after the firing, as shown in FIG. 3C, the rotary wheel 91 is maintained in engagement with the curved bottom hole 611 on the outward flange 61 of the stop block 6, and the first valve rod 51 is still maintained in the stopped position in stopping the air passage 701 from the air passage, therefore continuously depressing the trigger 8 does not cause the firing pin to work. When the safety 10 is left from the workpiece, second valve rod 71 of second air valve seat 7 is lowered with the front end of the actuating strip 9 to the original stand-by position. If the trigger 8 is maintained depressed and the safety 10 is stopped against the workpiece during this stage, no nail will be fired because the first valve rod 51 is still maintained in the stopped position in stopping the air passage 701 from the air passage 501. Therefore, the penumatic nail gun can be driven to fire nails again only when the trigger 8 is released to disconnect the rotary wheel 91 from the stop block 6 for allowing the first valve rod 51 to open the passage between the air passage 701 and the air passage 501.

Figure 4A:
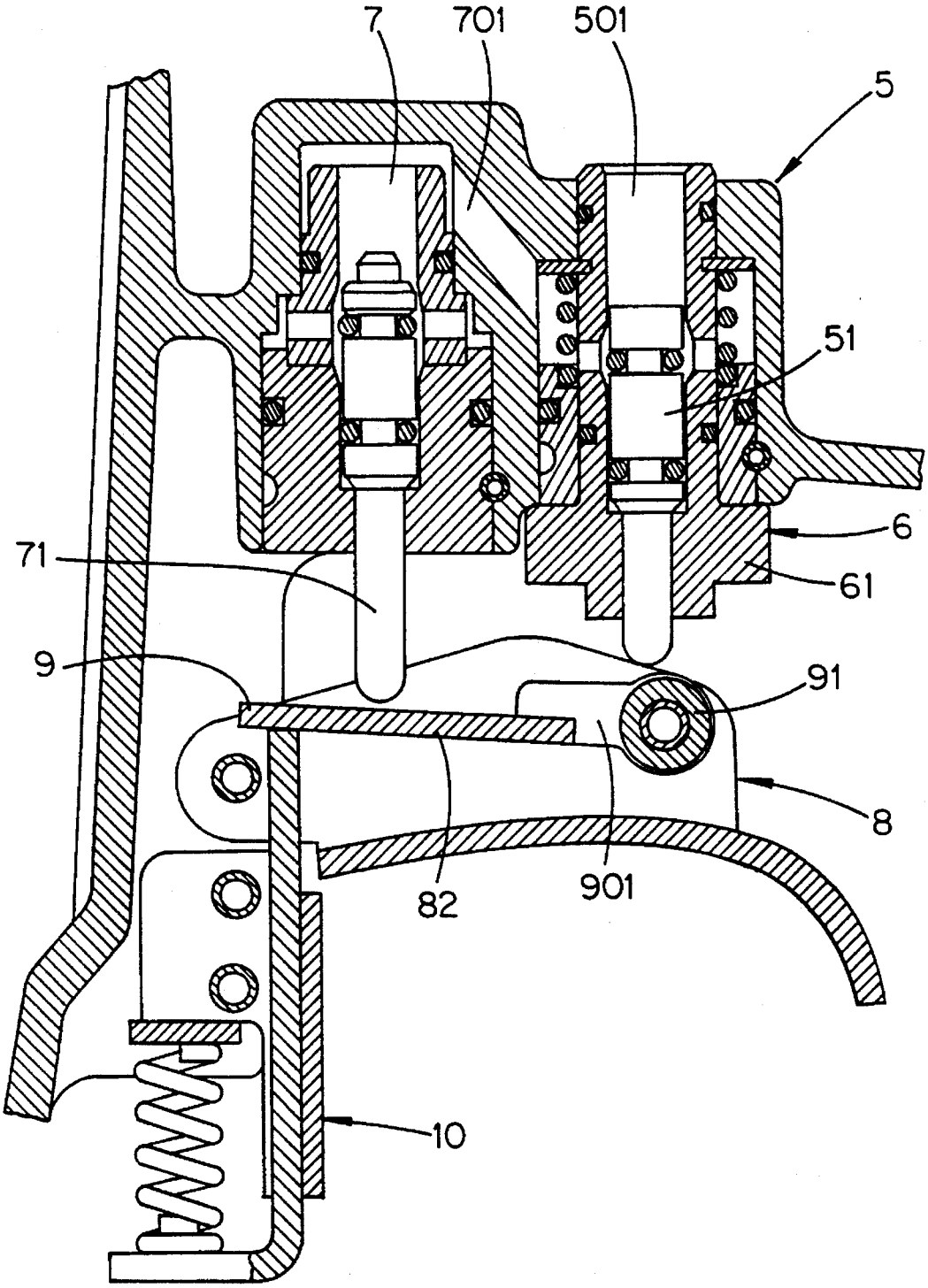
FIGS. 4A–4C are drawings of continuous action showing the single-shooting/continuous-shooting control switch of the preferred embodiment of the present invention installed in the penumatic nail gun and operated under the mode of continuous-shooting.
Figure 4B:
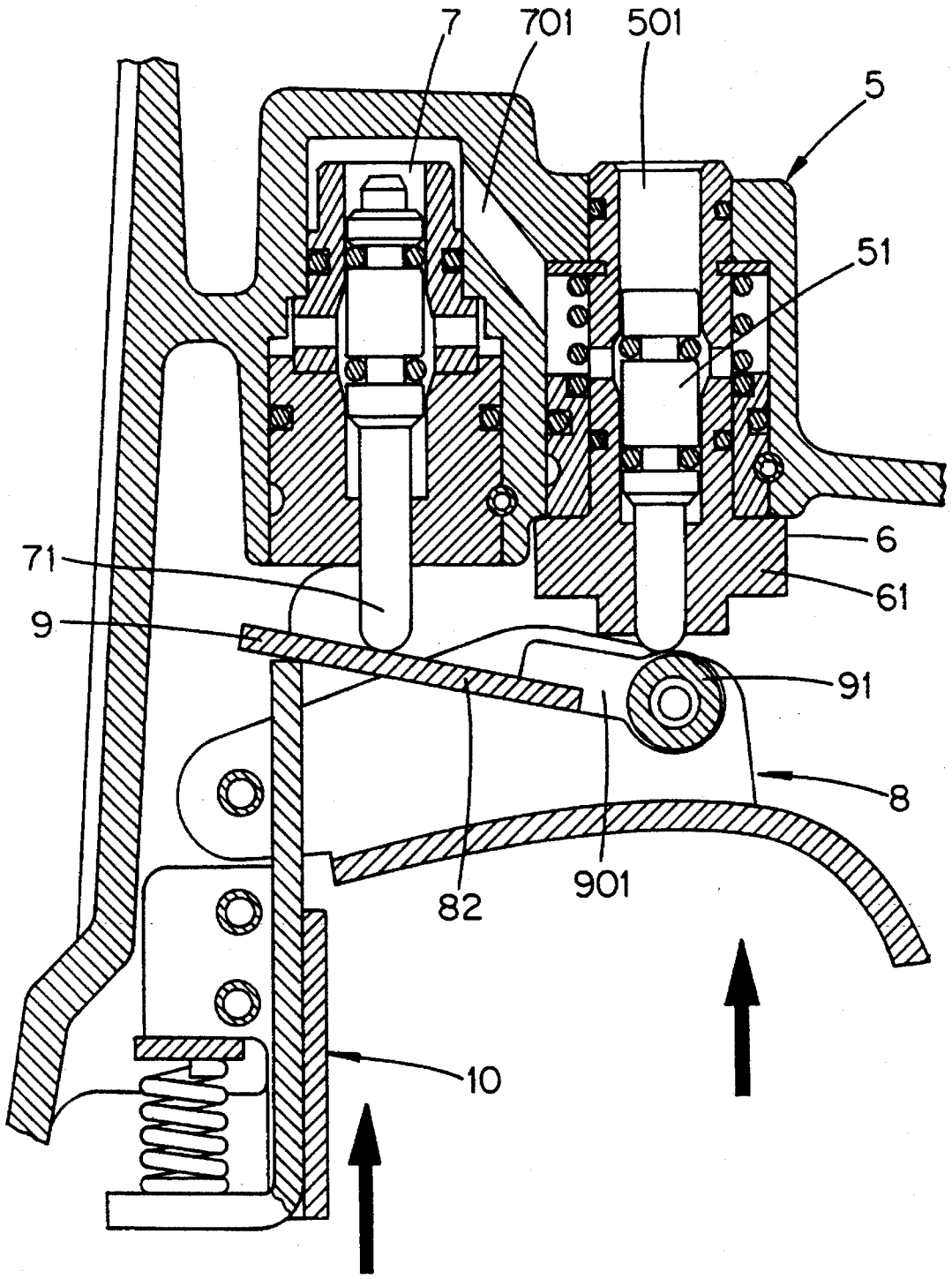
Figure 4C:
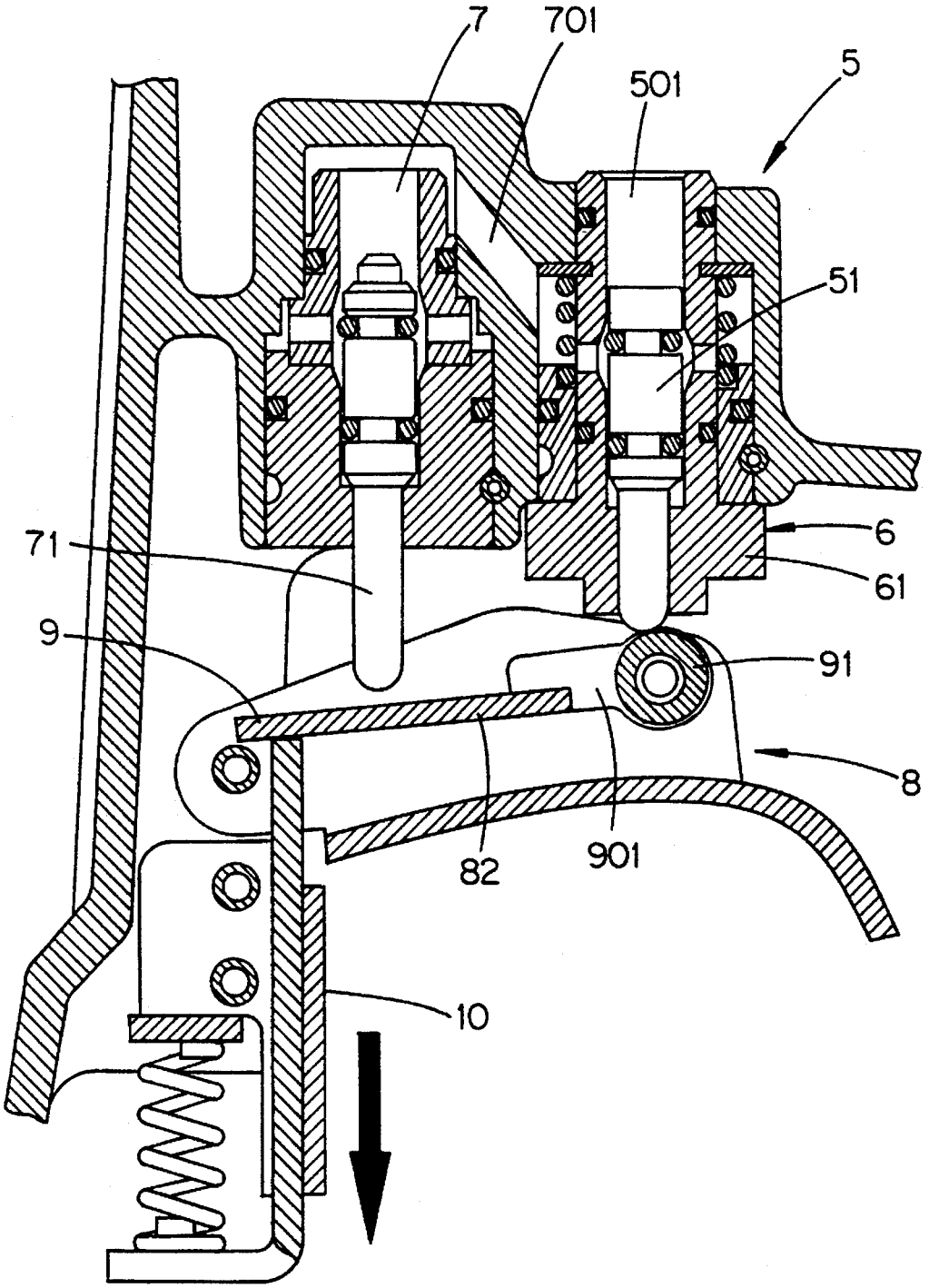

For a continuous shooting, please refer to FIGS. 4A and 4B. When the stop block 6 is turned in the .reversed direction through a predetermined angle, the downward bottom flange 61 of the stop block 6 becomes disposed perpendicular to the rotary wheel 91. When the trigger 8 is depressed during this stage, the downward bottom flange 61 of the stop block 6 stops the rotary wheel 91 from lifting the first valve rod 51, and therefore the pneumatic pressure is allowed to continuously pass from the air passage 501 into the air passage 701. If the safety 10 is stopped against the workpiece to lift the second valve rod 71, penumatic pressure is continuously forced out of the second air valve seat 7, causing the firing pin to fire a rapid and continuous stream of nails out of the pneumatic gun. When the safety 10 is removed from the workpiece, as shown in FIG. 4C, the actuating strip 9 and the second valve rod 71 immediately move to their former positions, causing the firing pin returned to the standy position. If the safety 10 is stopped against the workpiece and the trigger 8 is depressed again, the firing pin is triggered to fire a rapid and continuous stream of nails again.

It is to be understood that the drawings are designed for purposes of illustration only, and are not intended as a difinition of the limits and scope of the invention disclosed.

What is claimed is:

1. A single-shooting/continuous-shooting control switch installed in a pneumatic nail gun for controlling the firing of nails, the control switch comprising a first air valve seat, a first air passage for guiding pneumatic pressure from a pneumatic pressure source into said first air valve seat, a trigger, a first valve rod moved by said trigger to open and close said first air passage, an annular stop block fastened to said first air valve seat and turned about said first valve rod, a second air valve seat, a second air passage for guding penumatic pressure from said first air valve seat into said second air valve seat, a second valve rod moved by said trigger to open and close said second air valve so as to let penumatic pressure be driven out of said second air valve seat to drive a firing pin in firing nails out of the pneumatic nail gun, and wherein said stop block can be turned about said first valve rod between a first position for letting said first valve rod be lifted by said trigger to stop the passage between said first air passage and said second air passage for a single-shooting operation, and a second position to stop said trigger from lifting said first valve rod for letting pneumatic pressure be continuosuly drawn from said first air passage into said second air passage for a continuous shooting operation.

2. The single-shooting/continuous-shooting control switch of claim 2 wherein said stop block comprises a downward bottom flange defining a curved bottom hole, said curved bottom hole being disposed in engagement with one end of said trigger to let-said first valve rod be lifted by said trigger when said stop block is turned to said first position, said downward bottom flange being stopped against said trigger to prohibit said trigger from litling said first valve rod when said stop block is turned to said second position.

3. The single-shooting/continuous-shooting control swtich of claim 1 wherein said trigger Comprises a pivot transversely disposed at a free end thereof, a rotary wheel turned about said pivot, and an actuating strip having two parallel eyed lugs connected to two opposite ends of said rotary wheel and turned with said rotary wheel about said pivot to lift at least one of said first valve rod and said second valve rod.

* * * * *